United States Patent [19]

Mettenbrink

[11] 4,413,759

[45] Nov. 8, 1983

[54] DISPENSER FOR PASTY COMPOSITIONS

[75] Inventor: Herbert Mettenbrink, Lohne, Fed. Rep. of Germany

[73] Assignee: Bramlage GmbH, Lohne/Oldenburg, Fed. Rep. of Germany

[21] Appl. No.: 318,701

[22] Filed: Nov. 6, 1981

[30] Foreign Application Priority Data

Nov. 29, 1980 [DE] Fed. Rep. of Germany ..... 3045048

[51] Int. Cl.[3] ..... B05B 11/04; A47K 5/12

[52] U.S. Cl. ..... 222/213; 222/259; 222/260; 222/391

[58] Field of Search ..... 222/206, 207, 212, 213, 222/215, 214, 259, 260, 321, 391

[56] References Cited

U.S. PATENT DOCUMENTS 3,088,636 5/1963 Spatz ..... 222/213
3,361,305 1/1968 Spatz ..... 222/207
3,768,705 10/1973 Spatz ..... 222/213
4,154,371 5/1979 Kolaczinski et al. ..... 222/212

FOREIGN PATENT DOCUMENTS 48420 3/1982 European Pat. Off. ..... 222/207
848547 9/1960 United Kingdom ..... 222/213

*Primary Examiner*—Robert B. Reeves
*Attorney, Agent, or Firm*—Martin A. Farber

[57] ABSTRACT

The present invention relates to a dispenser for pasty compositions having a bellows on the top, a piston which travels in the direction towards the nozzle, and a rod which connects the bellows to the piston in such a manner that there is an idle stroke between piston rod and bellows so that a certain quantity of the content of the container withdraws into the nozzle channel upon release of the bellows.

9 Claims, 2 Drawing Figures

DISPENSER FOR PASTY COMPOSITIONS

Figure 1:
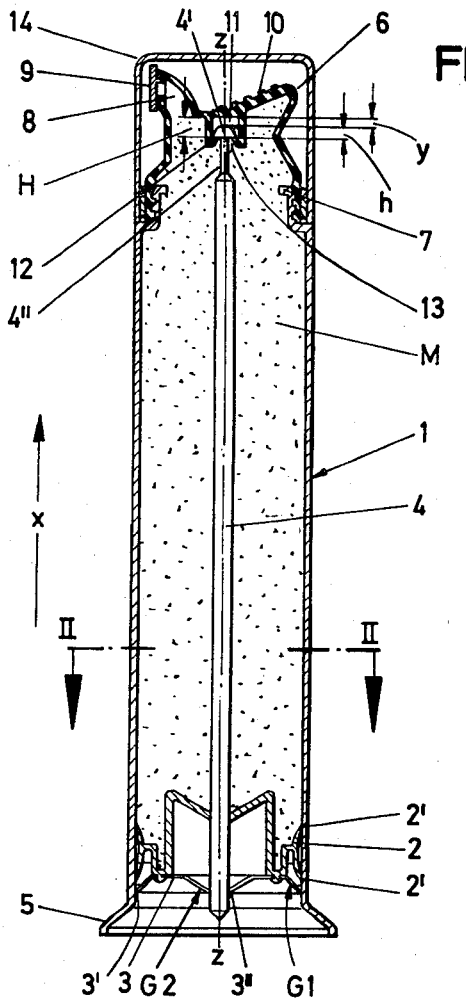

The present invention relates to a dispenser for pasty compositions having a piston which is arranged for displacement in the dispenser housing. The piston travels in the direction towards the nozzle opening during dispensing and is blocked against movement in the opposite direction by a catch. A push-button actuating surface is provided on a headpiece of the dispenser housing, the headpiece being collapsible in bellows-like manner.

As 12 10 149. The pasty composition is dispensed from the opening of the nozzle when the headpiece is pressed, the latter collapsing like a bellows. The pasty composition emerges from the opening of the nozzle. A valve provided to close the mouth of the opening upon a decrease in the pressure is incorporated in the nozzle opening. As has been shown in practice, such delivery valves are extremely sensitive to breakdown. One reason for this is that the headpiece is deformable and thus the forces of deformation also act to change the shape or position of the springs which produce the valve function. As a result, the mouth of the valve no longer applies the required closing force. Upon the end of the actuation, the content of the container continues to flow out, and the pasty mass forms a crust or residue on the region of the delivery side. Another disadvantage is that installation of such a delivery valve in a mass produced article such as, for instance, a throw-away toothpaste dispenser, is too expensive.

The object of the present invention is the development of a dispenser of this type in a structural form which is simpler to manufacture, and more advantageous to use in that no leaking takes place with the ordinary quantities dispensed. Thus, the afore-mentioned residue, which is subject to rapid drying, is avoided in front of the opening of the nozzle while, on the other hand, no special delivery valve is required.

This purpose is achieved by the invention with the introductorily-mentioned dispenser having a rod (4) which passes through the piston (2) and is coupled with the bellows-like headpiece (6) with the interpositioning of a free path (y), the rod being coupled in force-locked manner to the piston with the interpositioning of a second catch (G2) which operates in the direction opposite the first catch (G1).

As a result of this development, there is created a dispenser which operates without the conventional so-called "flutter valve" but which has the following substantial advantage in use. After the termination of the actuation, no residue forms in front of the opening of the nozzle. Rather, in accordance with the invention, the residue is sucked back into the opening of the nozzle. Accordingly, the residue is in direct communication with the dispenser contents and can retain its moisture to preclude drying out. This is made possible by providing a free path in the dispenser mechanism. This free path results in a shorter stroke of the piston which pushes the pasty mass forward in front of it as compared with a relatively larger actuating stroke of the headpiece. The headpiece is collapsible in bellows-like manner, provides a suction effect which sucks in the residue. Even accidental contact with the actuating surface of a push button of the headpiece by an amount equal to the free path does not result in any dispensing. At most, the mass is pushed forward by an amount equal to the depth by which it was drawn in; but then, upon return of the bellows-like headpiece, the mass is immediately drawn in again. Discharge takes place accordingly only upon the actual operating stroke, i.e. upon the displacement of the rod. The pulling back of the latter by the restoring force of the headpiece results in the raising of the level of the supply. Due to the free path the suction effect always takes place prior to this action. The two oppositely acting catches of the dispenser mechanism insure a reliable operation of the dispenser.

The structural means are simple and easy to install. Thus the rod is provided at its headpiece end with a tapered section having a widened end piece which lies in a chamber of the headpiece below the actuating surface of the push button. The chamber bottom extends below the rod and, in order to obtain the free path, the end piece is shorter than the height of the chamber. Simple attachment exists due to the fact that the end piece can be clipped in place through the opening in the bottom of the chamber. As a result of the fact that the rod is acted on by pull in order to convey the contents into the dispensing region of the dispenser, the cross section of the rod can be kept thin, which in turn increases the capacity.

Figure 2:
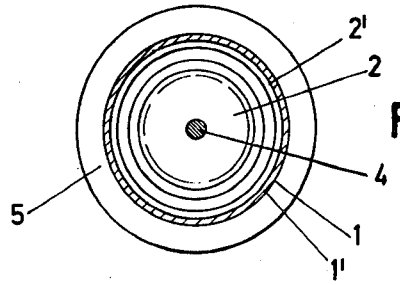

Other advantages and details of the object of the invention will be explained in further detail below with reference to a preferred illustrative embodiment shown in the drawing, in which FIG 1 is a vertical section through a dispenser developed in accordance with the invention, and FIG. 2 is a section along the line II—II of FIG. 1.

The elongated cylindrical housing 1 of the dispenser contains a piston 2. The edge lips 2' of the piston are guided on the inner wall 1' of the cylindrical housing. The housing 1 is open on the bottom.

The piston 2 can be displaced solely in the direction of discharge (arrow x). It bears a first catch G1 on its wide surface which faces that end of the housing on which the housing rests. This catch is a clamp module 3 in the form of a spider of spring steel having radially directed prongs 3'. Its diameter, which circumscribes the ends of the prongs, is somewhat greater than the inside diameter of the housing. As a result of this the ends of the prongs, as obliquely extending supporting feet, become hooked in catching fashion opposite the direction indicated by the arrow x against the inner wall 1' of the housing. A second catch G2 is formed in the center of this clamp module 3. A rod 4 which passes centrally through the piston 2 cooperates with this catch. Inwardly directed prongs 3'' of the catch G2 engage the rod 4 which is formed of a smooth bar. Projected in plan view, the passage opening left by the prongs 3'' is smaller than the diameter of the rod 4. The bottom end of the rod 4 is tapered. The supporting feet of the catch G2, which accordingly in this case also are oblique, permit an unimpeded passage of the rod 4 in a direction opposite the direction of the arrow x. other hand, a movement of the rod in the direction of the arrow x causes the piston 2 to be carried along due to the force-locked coupling.

For this drive, the housing 1 forms an actuating lever on the side opposite the standing base 5 of the housing. Included is a headpiece 6 which can collapse in bellows-like manner in the direction towards the piston 2 and then return into its erect basic position. The headpiece 6 is placed over a somewhat narrowed neck 7 of the housing 1. By means of a ring-groove engagement, in cooperation with the restoring force of the material which forms the headpiece 6, an attachment which is stable in use is obtained.

The headpiece 6 forms a channel-like dispenser nozzle opening 8 of reduced cross section. This opening is of spout shape. The preferably circular wall of its opening lies in the vicinity of the elongated lengthwise direction of the housing wall and can be closed by means of a plug 9 for storage.

In the back of the spout-like extension which circumscribes the nozzle opening, the headpiece 6 furthermore forms, in its roof portion, a push button actuating surface 10. This surface extends to just in front of the opposite theoretical extension of the plane of the housing wall and rises obliquely outwards.

Below this push-button actuating surface 10, the rod 4, which passes through the entire housing 1 in the longitudinal central axis z—z is connected to the headpiece 6. A chamber 11, developed for this purposes, is located on the headpiece 6 below the push-button actuating surface 10. The chamber is directed towards the inside of the housing. The chamber bottom 12 has an opening 13. The mushroom-shaped end piece 4' of the rod 4 is inserted through said opening. The attachment is effected in the manner of snap on clip attachment, i.e. the chamber bottom 12 engages below the widened end piece 4'. For said purpose, the rod 4 forms a tapered section 4'' at its headpiece end. This has the advantage that one can start from a continuous cross section of the rod in order to form the end piece 4'.

The opening 13 widens in funnel shape on its side facing the piston, as a result of which a dependable locking of rod 4 and headpiece 6 to each other is obtained despite the reduction in cross section in the region of the clip.

The fastening of the rod 4 to the headpiece is effected with the provision of a free path y.

For this purpose, the end piece 4' has a smaller height h than the height H of the chamber 11 which lies in the direction of the displacement of the rod. This leads to an idle stroke before the actual actuating stroke of the rod 4.

The manner of operation is as follows: The readiness position which is present after removal of the plug 9 leads, upon the bellows-like compression of the practically dome-shaped headpiece 6, to a displacement of the portion of the pasty composition M present in the headpiece, with the discharge of the customary amount dispensed. This, however, is only true when the rod 4, after passing through this idle stroke (free path y), is also displaced by a working stroke in a direction opposite that of the arrow x and therefore in the direction towards the bottom. As a result of the return of the headpiece which takes place after it has been released, the quantity delivered is again supplemented by ascent of the piston 2. Since its ascent takes place with a time delay, even though only slight, and the vacuum present in the headpiece produces a suction force, the delivery residue which protrudes beyond the opening 8 of the nozzle is always withdrawn immediately and therefore in advance. Accordingly, there is no residue which can harden thereon as a result of drying out by the surrounding outside air. Accordingly, no hardening plug is formed either. Rather, the portion which is drawn back into the lower region of the nozzle channel is joined directly with the moist supply. On the other hand, accidental contact with the actuating surface of the push button by an amount equal to the free path y also will not lead to dispensing of the contents. The corresponding idle stroke amounts to somewhat less than 1 mm in the case of the dimensional ratios shown in the drawing. For a larger piston surface and the same operating stroke by the push-button actuating surface 10 the idle stroke y must be suitably enlarged.

A cap 14 is provided over the headpiece 6. The cap holds, in frictionally snap locked and complementary, to a peripheral bead in the region of attachment thereof between the lower edge of the headpiece and the neck of the housing 1. By extending the nozzle opening 8, i.e. the mouth, into the region of the inner wall of the cap 14, a cover for the opening can be obtained as a result of this measure.

I claim:

1. In a dispenser for pasty composition, having a nozzle opening, a catch, a dispenser housing, and a piston which is arranged for displacement in the dispenser housing, travels in a direction towards said nozzle opening upon emptying of the dispenser, and is blocked in the opposite direction by said catch, a headpiece of said dispenser housing, and a push-button actuating surface which is provided on said headpiece, the headpiece being collapsible in bellows-like manner, pressing said headpiece increasing pressure on said pasty composition thereby forcing it through said nozzle, the improvement comprising a rod passes through the piston and is operatively coupled with the headpiece via a free path, means comprising another catch for coupling said rod in force-locked manner to the piston, said means operates in a direction opposite the first-mentioned catch.

2. The dispenser according to claim 1, wherein said headpiece forms a chamber located below the push-button actuating surface, said rod at a headpiece end thereof has a tapered section with a widened end piece, said end piece is disposed in the chamber of the headpiece and is engageable from below by a bottom of the chamber, and said end piece has a smaller height than the height of the chamber defining said free path.

3. The dispenser according to claim 2, wherein the bottom of the chamber is formed with an opening, said end piece is snapped in position through said opening of the bottom of the chamber.

4. The dispenser according to claims 1 or 2, wherein said bellows-like collapsible headpiece constitutes means for providing suction upon release of force to said push-button actuating surface.

5. The dispenser according to claim 4, wherein the bellows-like collapsible headpiece retracts an amount of said composition displaced by an accidental contact against said push-button actuating surface equal to said free path.

6. A dispenser for pasty matter comprising a housing, a deformable headpiece secured to said housing and having a nozzle therein adopted for dispensing of said pasty matter, a piston disposed in said housing and adapted for displacement in one direction toward said headpiece, a reciprocatably mounted rod, catch means coupling said piston to said housing and to said rod, said catch means for permitting said displacement of said piston in only said one direction to drive said matter toward said headpiece in response to reciprocating motion of said rod, and means for coupling said headpiece to said rod whereby pressing said headpiece increases pressure on said pasty matter thereby forcing it through said nozzle, said coupling means defining a free path for movement of said headpiece independently of said rod prior to operative engagement of said coupling means with said rod for retraction of partially dispensed matter.

7. The dispenser according to claim 6, wherein said coupling means includes a wall defining a chamber integrally formed within said headpiece, said rod has a mushroom-shaped end piece which is movably disposed within said chamber for translation along said chamber, and an end of the wall of said chamber envelops the end piece of said rod for engagement of the rod below the end piece.

8. The dispenser according to claim 6 or 7, wherein said catch means comprises a spider of spring material having substantially radially directed prongs operatively engaging said rod and said housing, respectively.

9. The dispenser according to claim 8, wherein said prongs are directed obliquely downwardly into engagement with said rod and said housing, respectively such that when said rod is depressed said tongs are fixed against said housing and slide relative said rod respectively and when said rod lifts said tongs jointly lift with said rod lifting said piston therewith and slide relative said housing, respectively.

* * * * *